US008087184B2

(12) United States Patent
Banta et al.

(10) Patent No.: US 8,087,184 B2
(45) Date of Patent: Jan. 3, 2012

(54) CLOTHES DRYER WITH EXTENDABLE RACK

(75) Inventors: Mark A. Banta, Crestwood, KY (US); Randall Calmeise, Louisville, KY (US); Michael Beyerle, Pewee Valley, KY (US); Jason King, North Canton, OH (US); Rebecca Eakins, Mount Vernon, WA (US); Derek Watkins, Elizabethtown, KY (US); Eric K. Watson, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/495,796

(22) Filed: Jul. 28, 2006

(65) Prior Publication Data

US 2008/0022551 A1 Jan. 31, 2008

(51) Int. Cl.
*F26B 11/02* (2006.01)

(52) U.S. Cl. ..... 34/602; 34/600

(58) Field of Classification Search ..... 34/600, 34/602, 237, 239; 296/37.16; 160/19, 23.1, 160/24, 299, 323.1
See application file for complete search history.

(56) References Cited

U.S. PATENT DOCUMENTS

| | | | | |
|---|---|---|---|---|
| 3,157,475 | A | 11/1964 | Stainbrook | |
| 3,363,326 | A * | 1/1968 | Weeks | 34/528 |
| 4,109,397 | A | 8/1978 | Daily | |
| 5,584,523 | A * | 12/1996 | Kawaguchi | 296/37.16 |
| 6,026,592 | A | 2/2000 | Herr | |
| 6,067,723 | A | 5/2000 | Lafrenz | |
| 6,154,978 | A | 12/2000 | Slutsky | |
| 6,385,862 | B1 | 5/2002 | Vande Haar | |
| 6,401,362 | B1 * | 6/2002 | Schultz et al. | 34/499 |
| 6,408,922 | B2 * | 6/2002 | Desrochers | 160/24 |
| 6,928,752 | B2 | 10/2004 | Johnson et al. | |
| 7,007,409 | B2 | 3/2006 | Moschutz et al. | |
| 7,032,326 | B2 | 4/2006 | Hong | |

FOREIGN PATENT DOCUMENTS

| | | | |
|---|---|---|---|
| EP | 1 522 625 | A1 | 4/2005 |
| GB | 2166692 | A * | 5/1986 |
| JP | 2001017797 | A * | 1/2001 |

* cited by examiner

*Primary Examiner* — Jiping Lu
(74) *Attorney, Agent, or Firm* — Global Patent Operation; Douglas D. Zhang

(57) ABSTRACT

A drum for a clothes dryer includes a generally cylindrical sidewall rotatable about a horizontal axis. The sidewall has an outer wall and an inner wall. The inner wall defines an interior volume for receiving articles to be dried. A hanger mechanism is coupled to the inner wall. The hanger mechanism is configured to support items hanged therefrom for drying without rotation of the drum. A shelf is coupled to the inner wall. The shelf is movable between a retracted position and an extended position. When extended, the shelf is configured to support articles to be dried. The drum is stationary during drying cycles wherein the hanger mechanism and the retractable shelf are in use. A heat source is operated at a reduced power level when the drum is not rotated.

9 Claims, 4 Drawing Sheets

CLOTHES DRYER WITH EXTENDABLE RACK

BACKGROUND OF THE INVENTION

This invention relates generally to clothes drying systems, and, more particularly, to non-tumbling drying aids for clothes dryers.

An appliance for drying articles, such as a clothes dryer for drying clothing, typically includes an exterior cabinet and internal rotating drum for tumbling clothes and laundry articles therein. One or more heating elements heats air prior to air entering the drum, and the warm air is circulated through the dryer as the clothes are tumbled to remove moisture from the laundry articles contained in the drum. As is widely known in the art, this process is continued for either a pre-established time period or until a sensor system signals that the clothing articles are dried to a desired level.

In addition to basic clothing articles, a clothes dryer is sometimes used to dry other wearable articles such as sneakers or shoes and the like. Tumbling such articles increases noise of operation of the dryer; and, because such articles have internal cavities into which the heated air does not readily flow, tumbling does not tend to facilitate improving dryer efficiency or decreasing drying time. A user may also have a need to dry other items, such as delicate articles, for which tumbling is not desired. In at least some clothes dryers, a removable shelf is provided to address these special needs. In use, the shelf is attached to a stationary part of the dryer interior. When not in use, the shelf must be stored outside of the dryer which creates an inconvenience. It would be advantageous to provide a more convenient and more flexible drying arrangement for such specialty articles.

BRIEF DESCRIPTION OF THE INVENTION

In one aspect, a drum for a clothes dryer is provided. The drum includes a generally cylindrical sidewall rotatable about a horizontal axis. The sidewall has an outer wall and an inner wall. The inner wall defines an interior volume for receiving articles to be dried. A hanger mechanism is coupled to the inner wall. The hanger mechanism is configured to support items hanged therefrom for drying without rotation of the drum.

In another aspect, a drum for a clothes dryer is provided. The drum includes a generally cylindrical sidewall rotatable about a horizontal axis. The sidewall has an outer wall and an inner wall. The inner wall defines an interior volume for receiving articles to be dried. A shelf is coupled to the inner wall. The shelf is movable between a retracted position and an extended position.

In a further aspect, a clothes dryer is provided that includes a drum for holding articles to be dried. The drum includes an inner wall defining an interior volume. A blower circulates heated air within the drum. A heat source provides heated air to the drum. A drive system is coupled to the drum and the blower. A controller is operatively coupled to the drive system. A shelf is coupled to the inner wall. The shelf is movable between a retracted position and an extended position.

DETAILED DESCRIPTION OF THE INVENTION

Figure 1:
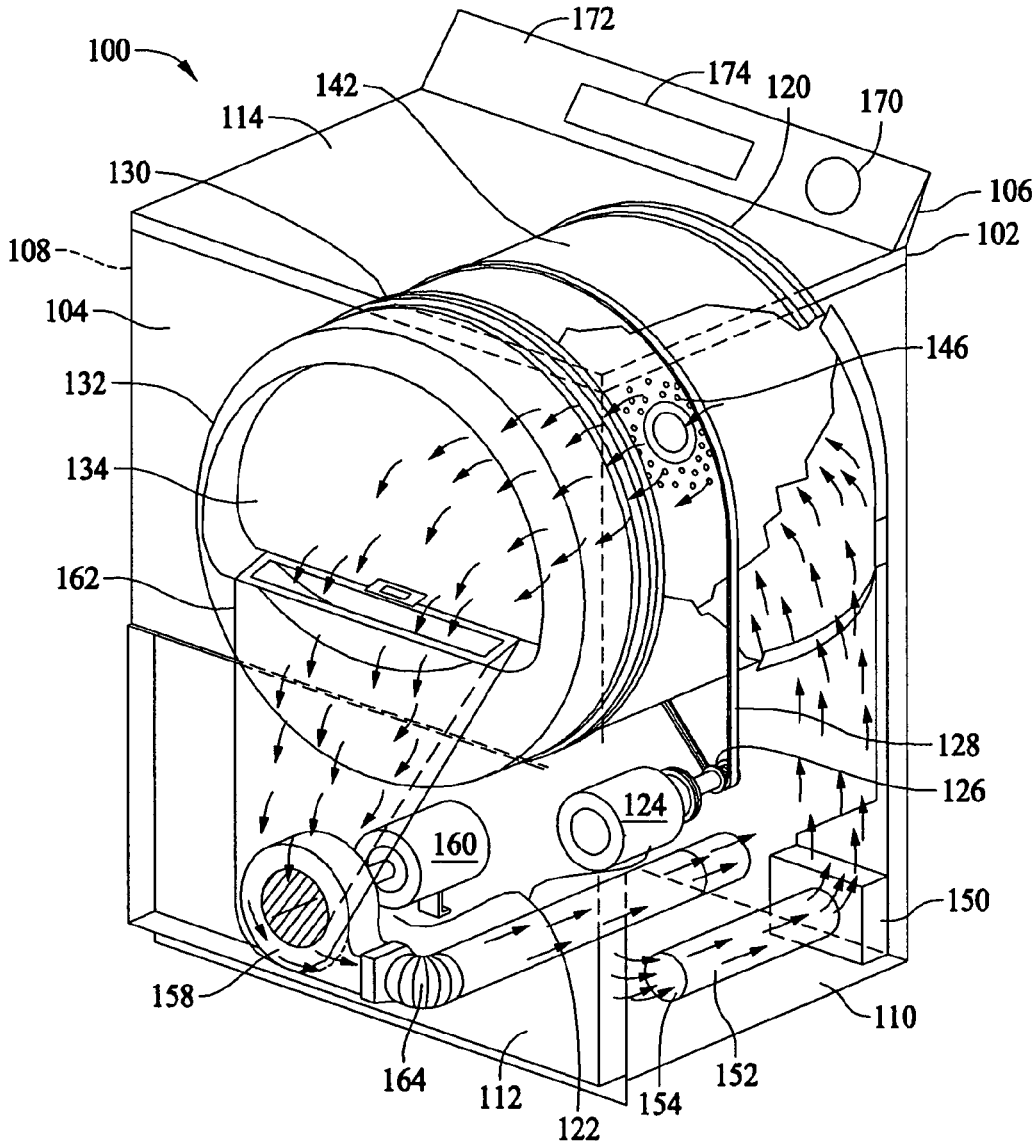
FIG. 1 is a perspective broken away view of an exemplary dryer appliance.

FIG. 1 illustrates an exemplary clothes dryer appliance 100 in which the herein described methods and apparatus may be practiced. While described in the context of a specific embodiment of dryer 100, it is recognized that the benefits of the herein described methods and apparatus may accrue to other types and embodiments of dryer appliances. Therefore, the following description is set forth for illustrative purposes only, and the herein described methods and apparatus is not intended to be limited in practice to a specific embodiment of a dryer appliance, such as dryer 100.

Clothes dryer 100 includes a cabinet or a main housing 102 including a front panel 104, a rear panel 106, a pair of side panels 108 and 110 spaced apart from each other by front panel 104 and rear panel 106, a bottom panel 112, and a top cover 114. Within cabinet 102 is a drum or container 120 mounted for rotation around a substantially horizontal axis. A drive mechanism 122 includes a motor 124 rotates drum 120 about the horizontal axis through a pulley 126 and a belt 128. Drum 120 includes a generally cylindrically shaped sidewall having an imperforate outer cylindrical wall 130 and a front flange or wall 132 defining an opening 134 to drum 120 for loading and unloading of clothing articles and other items.

A plurality of tumbling ribs or baffles (not shown in FIG. 1) are provided within drum 120 to lift clothing articles therein and then allow them to tumble back to the bottom of drum 120 as the drum rotates. Drum 120 includes a rear wall 142 rotatably supported within the main housing 102 by a suitable fixed bearing. Rear wall 142 includes a plurality of holes 146 that receive hot air that has been heated by a heater 150 in communication with an air supply duct 152 and duct inlet 154. The heated air is drawn from the drum 120 by a blower fan 158. Drive mechanism 122 also drives blower fan 158. In the illustrated embodiment, drive mechanism includes a second motor 160 for driving blower fan 158. The air passes through a screen filter 162 which traps any lint particles. As the air passes through the screen filter 162, it enters a trap duct seal and is passed out of the clothes dryer through an exhaust duct 164. After the clothing articles have been dried, they are removed from drum 120 via opening 134.

Drive mechanism 122 is configured such that drum 120 and blower fan 158 may be independently operated. Drive mechanism 122, in one embodiment may include separate motors 124 and 160. In alternative embodiments, drive mechanism may include a single motor in combination with other systems such as an adjustable idler, a slipping belt system, or a clutch system, and the like that enable drum 120 to remain stationary while maintaining airflow through drum 120.

A cycle selector knob 170 is mounted on a cabinet backsplash 172 and is in communication with a control system 174. Signals generated in control system 174 operate drum 120 and heater 150 in response to a position of selector knob 170. Blower motor 160 may be a variable speed motor that is controlled by control system 174.

Figure 2:
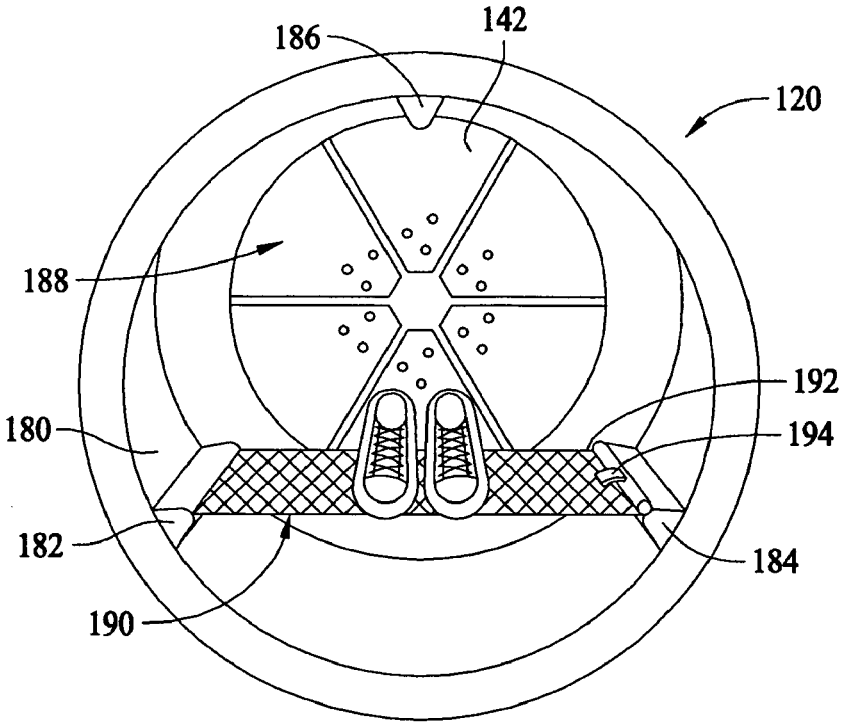
FIG. 2 is a perspective view of a dryer drum formed in accordance with an exemplary embodiment of the present invention.
Figure 3:
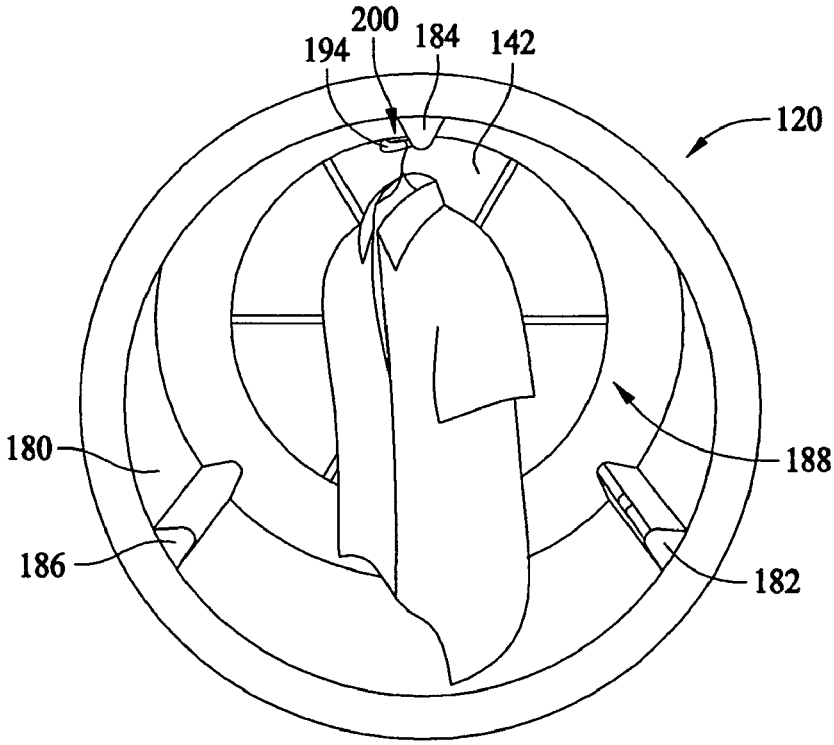
FIG. 3 is an alternative view of the dryer drum shown in FIG. 2.

FIG. 2 illustrates a perspective view of dryer drum 120 formed in accordance with one embodiment of the present invention. FIG. 3 illustrates an alternative embodiment of the present invention. Drum 120 includes an inner wall 180 upon which there are mounted baffles 182, 184, and 186. Inner wall 180 defines an interior volume 188 for receiving articles to be dried. In FIG. 2, drum 120 includes a flexible shelf 190 that is extended across a portion of interior volume 188 between baffles 182 and 184. Flexible shelf 190 is movable from a retracted position wherein flexible shelf 190 is stored within baffle 182 to an extended position as shown wherein an exterior end 192 of flexible shelf 190 is coupled to a retention member 194. When in the extended position, flexible shelf 190 is configured to support articles to be dried without tumbling.

In FIG. 3, flexible shelf 190 is retracted within baffle 182 and drum 120 is rotated such that baffle 184 in a substantially uppermost position inside drum 120. Baffle 184 includes a hanger mechanism 200 that, in one embodiment, includes retention member 194. In other embodiments, hanger mechanism 200 may include an eyelet or a slot formed either in inner wall 180 or in baffle 184. When drum 120 is rotated to position hanger mechanism 200 in an upper portion of interior volume 188 of drum 120, hanger mechanism 200 may be utilized to facilitate hanging clothing articles within drum 120 to be dried without tumbling. When flexible shelf 190 is being used or when hanger mechanism 200 is employed for hanging of articles therefrom, appropriate drying cycles are selected so that dryer 100 is operated with blower motor 160 activated to supply heated air and with motor 124 deactivated such that drum 120 does not rotate. In addition, during these cycles, the dryer temperature is limited by operating heater 150 (FIG. 1) at a reduced power level. In one embodiment, heater 150 is operated at one quarter of its maximum power. In embodiments wherein dryer 100 is an electric dryer, the power level of heater 150 may be varied by varying the voltage or current to heater 150. In other embodiments, wherein dryer 100 is a gas dryer, a gas valve (not shown) is provided to limit the gas flow to heater 150.

Figure 4:
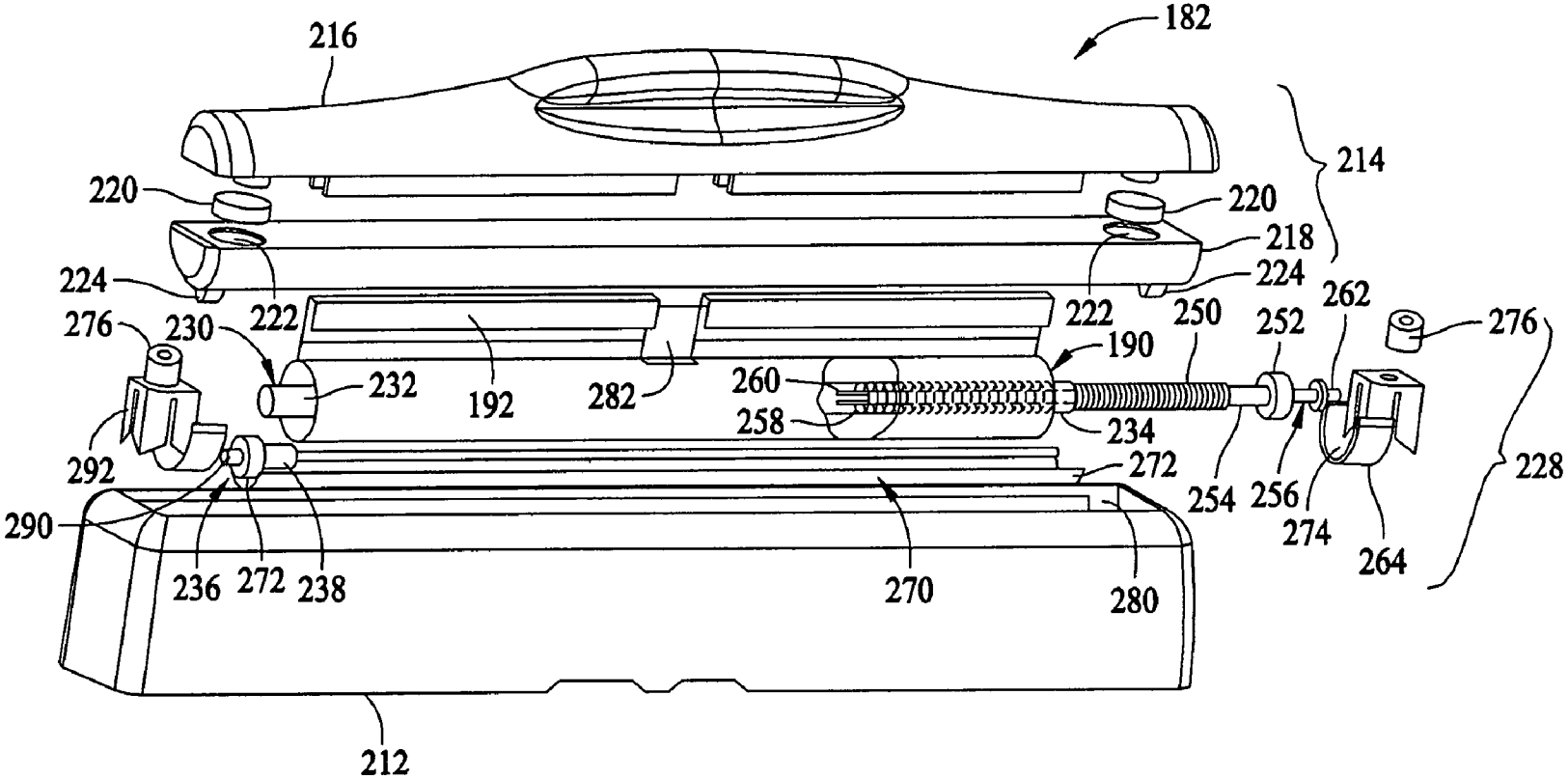
FIG. 4 is an exploded view of a baffle and flexible shelf assembly.

FIG. 4 illustrates an exploded view of a baffle assembly 210 that includes baffle 182 and flexible shelf 190. Baffle 182 includes a baffle base 212, and a handle assembly 214 that includes an upper handle 216 and a lower handle 218. Exterior end 192 of flexible shelf 190 is received in and coupled to lower handle 218. Magnets 220 are located in recesses 222 in lower handle 218. Upper handle 216 and lower handle 218 are joined to one another using known fasteners (not shown). Positioning tabs 224 are formed on a lower surface of lower handle 218. Tabs 224 are configured to fit into recesses (not shown) formed in base 212 to inhibit movement of handle assembly 214 during normal operation of dryer 100.

Assembly 210 further includes an operating mechanism 228 for flexible shelf 190. Operating mechanism 228 includes a tubular rod 230 having a first end 232 and an opposite second end 234. A pivot cap 236 has an end 238 that is received in first end 232 of rod 230 and a pivot end 240 that is received in an end cap 242 for relative rotation therewith. Flexible shelf 190 includes an interior end (not shown) that is attached to rod 230. A biasing member 250, which in one embodiment may be a torsional spring, is received in second end 234 of rod 230. A pivot cap 252 is coupled to one end 254 of biasing member 250. A non-rotating rod 256 extends through pivot cap 252 and biasing member 250 to the interior of rod 230. A second end 258 of biasing member 250 is coupled to an interior end 260 of non-rotating rod 256 as shown in the cut away portion of flexible shelf 190. A second end 262 of non-rotating rod 256 is received in a second end cap 264 without relative rotation therebetween. Pivot cap 252 pivots or rotates on non-rotating rod 256. A shelf guard 270 has ends 272 that are received in arcuate channels 274 formed in end caps 242 and 264. Shelf guard 270 sets a width of flexible shelf mechanism 228 or a spacing between end caps 242 and 264. Shelf guard 270 also allows biasing member 250 to be pre-loaded. Metallic spacers 276 are attached to an upper portion of each end cap 242 and 264. Spacers 276 are attracted to magnets 220 in lower handle 218 to keep the handle assembly 214 in place during normal dryer operation. The attraction of spacers 276 to magnets 220 also provides feedback to the consumer that the handle assembly 214 is fully retracted. Flexible shelf 190 and the assembled shelf mechanism 228 are received in a cavity 280 in base 212. Flexible shelf 190 includes an opening 282 proximate exterior end 192 that receives retention member 194 (FIG. 2) when flexible shelf 190 is extended. In an exemplary embodiment, flexible shelf 190 is fabricated from a flexible mesh screen material.

In use, handle assembly 214 is pulled across the interior of drum 120 to a baffle such as baffle 184 having a retention member 194. As handle assembly 214 is pulled, flexible shelf 190 is unrolled from rod 230 and pivot caps 236 and 252 rotate along with end 254 of biasing member 250. As pivot cap 252 is rotated, biasing member 250 generates a tension force on flexible shelf 190 that tends to retract flexible shelf 190. When flexible shelf 190 is sufficiently extended, retention member 194 is inserted through opening 282 to engage handle assembly 214 thereby retaining flexible shelf 190 in an extended position for supporting articles to be dried. Appropriate dryer settings are then selected so the drum 120 does not rotate. When released from retention member 194, flexible shelf 190 automatically retracts into baffle 182.

Figure 5:
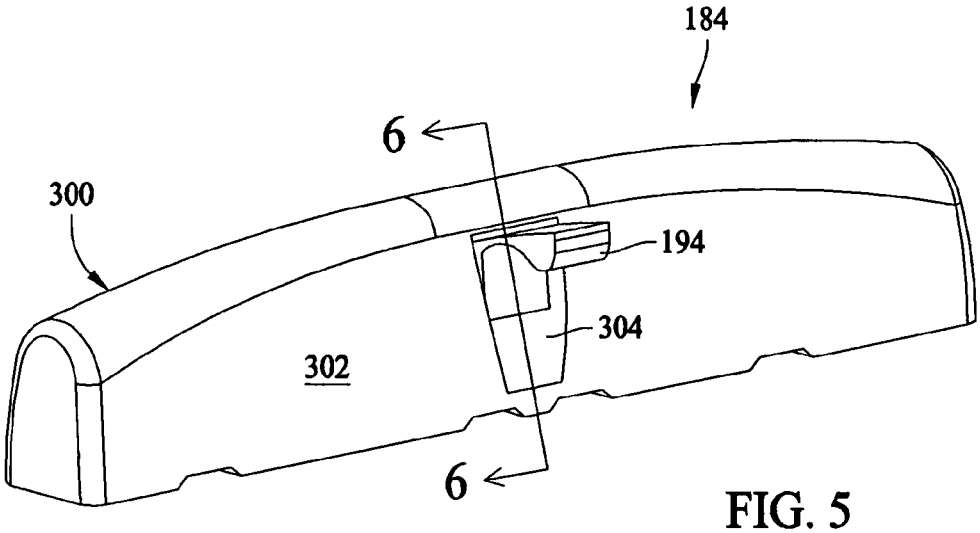
FIG. 5 is a perspective view of a baffle with a hook assembly.
Figure 6:
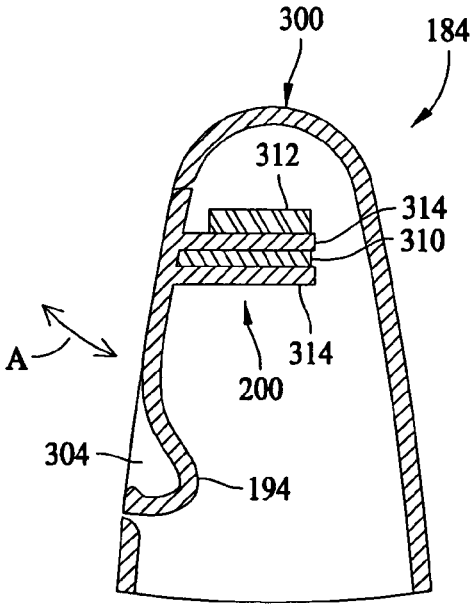
FIG. 6 is a cross sectional view of the baffle shown in FIG. 5 taken along the line 6-6.

FIG. 5 illustrates a perspective view of baffle 184. FIG. 6 illustrates a cross sectional view of baffle 184. Retention member 194 is movable between an extended position as shown in FIG. 5 and a retracted position shown in FIG. 6. Baffle 184 includes a shell 300 having a front outer surface 302. Shell 300 is formed with a recess or clearance hole 304 that is sized to receive retention member 194 when retention member 194 is retracted such that retention member 194 fits flush with front outer surface 302. Retention member 194 is pivotably coupled to shell 300 and is configured to pivot or rotate with respect to shell 300 in the direction of the arrow A.

Retention member 194 is a part of hook assembly 200 that also includes a magnet 310. Baffle 184 also includes a bracket 312. Retention member 194 is formed with a pair of internally extending flanges 314. Magnet 310 is mounted between flanges 314 and pivots or rotates with retention member 194. Bracket 312 is mounted to the interior of shell 300 and is positioned so that magnetic attraction between magnet 310 and bracket 312 holds retention member 194 in the retracted position when retention member 194 is not being used. In use, retention member 194 is pulled from the recess in shell 300 such that retention member 194 may support garments for hang drying when baffle 184 is positioned in an upper portion of the interior volume of drum 120. Retention member 194 may also provide support to flexible shelf 190 when flat drying.

The embodiments thus described provide a clothes dryer that no longer requires the consumer to store a drying rack outside the dryer compartment. The dryer includes a baffle having a flexible shelf stored therein. The flexible shelf is pulled from the baffle when in use and automatically retracts into the baffle when not in use. In addition, the capability to hang dry a garment within the dryer drum is provided. Only the blower motor is in operation when these dryer cycles are selected.

While the invention has been described in terms of various specific embodiments, those skilled in the art will recognize that the invention can be practiced with modification within the spirit and scope of the claims.

What is claimed is:

1. A drum for a clothes dryer, said drum comprising:

a generally cylindrical sidewall rotatable about a horizontal axis, said sidewall having an outer wall and an inner wall, said inner wall defining an interior volume for receiving articles to be dried;

a first baffle coupled to said inner wall;

a second baffle coupled to said inner wall;

a third baffle coupled to said inner wall;

a retractable shelf comprising a first end and coupled to said first baffle, wherein an opening is defined within said retractable shelf proximate to said first end, said retractable shelf movable between a retracted position and an extended position, said retractable shelf configured to be stored within said first baffle when in the retracted position, and said retractable shelf engagable in the extended position to said second baffle; and a retention member coupled to said second baffle, said retention member insertable through said opening for engaging said retractable shelf in the extended position, said retention member magnetically retained within said second baffle when said retractable shelf is in the retracted position.

2. A drum in accordance with claim 1 further comprising a biasing member coupled to said retractable shelf and biasing said retractable shelf in the retracted position.

3. A drum in accordance with claim 2 wherein said first baffle includes said retractable shelf and said biasing member therein.

4. A drum in accordance with claim 3 wherein said first baffle comprises a handle assembly movable between a retracted position and an extended position to extend said retractable shelf.

5. A drum in accordance with claim 3 wherein said first baffle includes a base sized to house said retractable shelf therein and wherein said retractable shelf has an exterior end coupled to a handle.

6. A drum in accordance with claim 5 wherein said handle is magnetically attracted to said base when said retractable shelf is in the retracted position.

7. A drum in accordance with claim 1 wherein said retractable shelf engages said retention member when in the extended position to retain said retractable shelf in the extended position and wherein said retractable shelf disengages from said retention member to move to the retracted position.

8. A drum in accordance with claim 7 wherein said retention member is movable between an extended position and a retracted position, said retractable shelf is engagable to said second baffle only when said retention member is in the extended position, said retractable shelf configured to support articles to be dried.

9. A drum for a clothes dryer, said drum comprising:

a generally cylindrical sidewall rotatable about a horizontal axis, said sidewall having an outer wall and an inner wall, said inner wall defining an interior volume for receiving articles to be dried;

a first baffle coupled to said inner wall;

a second baffle coupled to said inner wall and comprising a retention member movable between an extended position and a retracted position, said retention member magnetically retained within said second baffle when said retention member is in the retracted position; and a retractable shelf comprising a first end and coupled to said first baffle, wherein an opening is defined within said retractable shelf proximate to said first end such that said retention member is insertable through said opening, said retractable shelf movable between a retracted position and an extended position, said retractable shelf configured to be stored within said first baffle in the retracted position, said retractable shelf engagable to said second baffle in the extended position only when said retention member is in the extended position.

* * * * *